US010126101B2

(12) United States Patent
Ell

(10) Patent No.: US 10,126,101 B2
(45) Date of Patent: Nov. 13, 2018

(54) SEEKER/DESIGNATOR HANDOFF SYSTEM FOR USE IN DUAL-MODE GUIDED MISSILES

(71) Applicant: Rosemount Aerospace Inc., Burnsville, MN (US)

(72) Inventor: Todd Ell, Savage, MN (US)

(73) Assignee: Rosemount Aerospace Inc., Burnsville, MN (US)

( * ) Notice: Subject to any disclaimer, the term of this patent is extended or adjusted under 35 U.S.C. 154(b) by 304 days.

(21) Appl. No.: 15/269,601

(22) Filed: Sep. 19, 2016

(65) Prior Publication Data

US 2018/0080740 A1 Mar. 22, 2018

(51) Int. Cl.
*F41G 7/26* (2006.01)
*F41G 7/22* (2006.01)
(Continued)

(52) U.S. Cl.
CPC ..... *F41G 7/26* (2013.01); *F41G 3/145* (2013.01); *F41G 7/008* (2013.01); *F41G 7/226* (2013.01); *F41G 7/2246* (2013.01); *F41G 7/2293* (2013.01)

(58) Field of Classification Search
CPC . F41G 7/26; F41G 7/226; F41G 7/008; F41G 7/224; F41G 7/229; F41G 3/145; F41G 3/165; G01S 7/481; G01S 7/4802
See application file for complete search history.

(56) References Cited

U.S. PATENT DOCUMENTS 4,324,491 A * 4/1982 Hueber ..... F41G 7/2293 244/3.13
4,386,848 A * 6/1983 Clendenin ..... F41G 3/165 356/5.01

(Continued)

FOREIGN PATENT DOCUMENTS

EP 1035399 A1 9/2000
EP 1607710 A1 12/2005

(Continued)

OTHER PUBLICATIONS

Extended European Search Report, for European Patent Application No. 17191266.0, dated Feb. 19, 2018, 11 pages.

*Primary Examiner* — Bernarr E Gregory
(74) *Attorney, Agent, or Firm* — Kinney & Lange, P.A.

(57) ABSTRACT

Apparatus and associated methods relate to a dual-mode seeker for a guided missile equipped with seeker/designation handoff capabilities. The dual-mode seeker has Semi-Active Laser (SAL) and Image InfraRed (IIR) modes of operation. SAL-mode operation includes detecting laser pulses reflected by a target designated by a remote Laser Target Designator (LTD) and determining target direction using the detected laser pulses. SAL-mode operation also includes determining the Pulse Repetition Interval (PRI) of the detected laser pulses, and predicting timing of future pulses generated by the LTD. IIR-mode operation includes capturing Short-Wavelength InfraRed (SWIR) images of a scene containing the designated target and determining target location using one or more image features associated with the designated target. After the target direction can be determined using the IIR-mode of operation, an illuminator projects a signal onto the designated target so as to communicate to a remote operator that LTD target designation can be suspended.

20 Claims, 7 Drawing Sheets

(51) Int. Cl.

| | |
|---|---|
| ***F41G 7/00*** | (2006.01) |
| ***F41G 3/14*** | (2006.01) |
| *F41G 3/00* | (2006.01) |

(56) References Cited

U.S. PATENT DOCUMENTS

| | | | | |
|---|---|---|---|---|
| 5,345,304 | A * | 9/1994 | Allen | G01S 7/4802 250/203.2 |
| 5,350,134 | A | 9/1994 | Crawford | |
| 6,111,241 | A | 8/2000 | English et al. | |
| 6,262,800 | B1 | 7/2001 | Minor | |
| 6,359,681 | B1 * | 3/2002 | Housand | G01S 7/481 356/4.01 |
| 6,864,965 | B2 * | 3/2005 | DeFlumere | F41G 3/06 356/141.1 |
| 7,183,966 | B1 * | 2/2007 | Schramek | F41G 7/008 244/3.1 |
| 7,725,257 | B2 | 5/2010 | Strelow et al. | |
| 7,909,253 | B2 | 3/2011 | Sherman | |
| 8,525,088 | B1 | 9/2013 | Ell et al. | |
| 8,829,404 | B1 | 9/2014 | Rinker | |
| 9,163,905 | B2 * | 10/2015 | Ell | F41G 7/008 |
| 9,207,053 | B2 | 12/2015 | Ell et al. | |
| 9,383,170 | B2 * | 7/2016 | Ell | F41G 7/008 |
| 2009/0100995 | A1 * | 4/2009 | Fisher | F41G 7/226 89/1.11 |
| 2015/0268345 | A1 | 9/2015 | Ell | |

FOREIGN PATENT DOCUMENTS

| | | |
|---|---|---|
| EP | 2816309 A2 | 12/2014 |
| GB | 2515121 A | 12/2014 |

* cited by examiner

SEEKER/DESIGNATOR HANDOFF SYSTEM FOR USE IN DUAL-MODE GUIDED MISSILES

BACKGROUND

Semi-Active Laser (SAL) guided missile systems are used when destruction of a specific target requires precision. In some cases, such precision is needed to minimize collateral damage. In some cases, such precision is desired to ensure that a high-value target is successfully destroyed.

The principle of operation of SAL guided missile systems is to "paint" or designate a target with a signal that is perceivable by a missile. A system called a seeker is responsible for perceiving the signal reflected by the designated target. A forward positioned operator may paint the desired target using a Laser Target Designator (LTD), for example. An LTD can have a Short-Wave Infrared Radiation (SWIR) laser to generate a sequence of laser pulses to be used to paint the target. The sequence of pulses can have a Pulse Repetition Interval (PRI) or a Pulse Repetition Frequency (PRF) that can function as a signature of the LTD.

The seeker of the SAL guided missile can be equipped with a SWIR detector, which can be configured to detect SWIR signals and to determine whether the detected SWIR signals have a PRI corresponding to the LTD. The seeker can be matched or paired with a specific LTD by configuring both the LTD and the seeker with the same PRF/PRI. If the SWIR detector determines that the detected SWIR signals have the PRI signature of the LTD, then the target from which the detected signal is reflected is deemed to have been designated by the LTD. The seeker then can sense this reflected designation signal and also can determine the direction of the target relative to the guided missile. The seeker may output a signal indicative of the determined direction for use by a guidance system on the missile. The missile's guidance system then can direct the missile to the designated target.

Some seekers also have a passive Imaging InfraRed (IIR) target location system in addition to a SAL target location system. Such seekers are sometimes called dual-mode seekers. The passive IIR target locator can include an infrared camera to capture images of a scene that includes the target designated by the LTD. Image features corresponding to the designated target can be identified. Image coordinates of the identified features within the captured images can be used to determine the direction of the target relative to the missile. Reliable identification of imaged target features, however, can be performed only when the target features are imaged by a sufficient number of pixels in an imager. The number of "pixels on target" increases as the range closes between the missile and the target. The signal strength of the ambient infrared light emitted from and/or reflected by the imaged scene can be much lower than the signal strength of the pulsed laser signal generated by an LTD and reflected by the target. Thus, target detection and location using an IIR-mode of operation can be performed when the range between the target and missile is relatively close. For long-range target detection and location, SAL-mode operation can be better used, due to the relatively high signal strength of the LTD laser signal.

A dual-mode guided missile can be launched by a launching vehicle that is located a great distance from a desired target. The dual-mode seeker of such a launched missile might first acquire a target using the SAL-mode of target detection and location, due to the relatively large signal strength of the LTD laser signal. When the range to the designated target closes to a distance at which the passive IIR-mode of target detection and location can be used, the seeker can switch modes to the IIR-mode of operation.

Although the forward positioned LTD operator is no longer required to continue painting the target after the dual-mode missile has switched to the IIR-mode of operation, the forward positioned LTD operator often has no way of knowing this. The forward positioned LTD operator often is totally ignorant of the missile's mode of operation. The forward positioned LTD operator then continues painting the target until the missile strikes the target. There is a need for the forward positioned LTD operator to be permitted to disengage the target at the earliest time possible. If the LTD operator were made aware of when the guided missile transitions from the SAL-mode to the IIR-mode of operation, he/she could suspend the painting of the target, and perhaps could evacuate the forward position, even before the missile strikes the designated target.

SUMMARY

Apparatus and associated devices relate to a dual-mode seeker for a guided missile. The dual-mode seeker includes a first-mode target locator, a second-mode target locator and an active Short-Wavelength InfraRed (SWIR) target illuminator. The first-mode target locator is configured to detect laser pulses reflected by a target within a scene aligned along an optical axis of the dual-mode seeker. Each of the laser pulses is projected onto the target by a remote Laser Target Designator (LTD), thereby designating the target. The first-mode target locator is further configured to determine, based on the detected laser pulses, a direction of the designated target relative to the optical axis. The first-mode target locator is further configured to generate an output signal indicative of the direction of the designated target relative to the optical axis. The second-mode target locator is configured to capture Short-Wavelength InfraRed (SWIR) images of the aligned scene. Each of the SWIR images is captured at an exposure time period in which the remote LTD is not projecting a laser pulse onto the designated target. The second-mode target locator is further configured to identify an image feature corresponding to the designated target within each of the SWIR images. The second-mode target locator is further configured to determine, based on the identified image feature, the direction of the designated target relative to the optical axis. The second-mode target locator is further configured to generate an output signal indicative of the direction of the designated target relative to the optical axis. The active SWIR illuminator is aligned with the optical axis and configured to illuminate the designated target during an illumination time offset by a Phase Offset Interval (POI) from the exposure time period.

Some embodiments relate to a Laser Target Designator (LTD) for a guided missile. The LTD includes a laser and a Short-Wavelength InfraRed (SWIR) camera. The laser is configured to project laser pulses onto a target aligned along a laser axis, thereby designating the target. The laser pulses are projected at a Pulse Frequency Rate (PFR). The SWIR camera is configured to capture SWIR images of a scene aligned along the laser axis. The SWIR camera is further configured to detect SWIR illumination pulses of the designated target by a target illuminator of a guided missile. The SWIR camera is also configured to identify a Pulse Offset Interval (POI) between the projected laser pulses and the detected SWIR illumination pulses.

Some embodiments relate to a method of tracking a target for a guided missile. The method includes projecting laser pulses onto a target, thereby designating the target. The method includes detecting laser pulses reflected by a designated target. The method includes determining, based on the detected laser pulses, a direction of the designated target. The method includes generating an output signal indicative of the direction of the designated target. The method includes capturing SWIR images of a scene that includes the designated target. Each of the SWIR images is captured at an exposure time period in which laser pulses are not being projected onto the designated target. The method includes identifying an image feature within each of the SWIR images. The identified image feature correspond to the designated target. The method includes determining, based on the identified image feature, the direction of the designated target. The method includes generating an output signal indicative of the direction of the designated target. The method includes illuminating the designated target during an illumination time offset by a POI from the exposure time period.

Some embodiments relate to a system for tracking a target for a guided missile. The system includes a laser-pulse detector configured to detect laser pulses reflected by a target within a scene aligned along an optical axis. Each of the laser pulses is projected onto the target by a remote LTD thereby designating the target. The system includes a SWIR camera configured to capture images of a aligned scene. The system a target illuminator configured to illuminate the aligned scene. The system includes one or more processors. The system includes computer-readable memory encoded with instructions that, when executed by the one or more processors, cause the system to detect, using laser-pulse detected, laser pulses reflected by the designated target. The computer-readable memory is encoded with instructions that, when executed by the one or more processors, cause the system to determine, based on the detected laser pulses, a direction of the designated target relative to the optical axis. The computer-readable memory is encoded with instructions that, when executed by the one or more processors, cause the system to generate an output signal indicative of the direction of the designated target relative to the optical axis. The computer-readable memory is encoded with instructions that, when executed by the one or more processors, cause the system to capture SWIR images of the aligned scene. Each of the SWIR images captured at an exposure time period in which the remote LTD is not projecting a laser pulse onto the designated target. The computer-readable memory is encoded with instructions that, when executed by the one or more processors, cause the system to identify an image feature within each of the SWIR images, the image feature corresponding to the designated target. The computer-readable memory is encoded with instructions that, when executed by the one or more processors, cause the system to determine, based on the identified image feature, the direction of the designated target relative to the optical axis. The computer-readable memory is encoded with instructions that, when executed by the one or more processors, cause the system to generate an output signal indicative of the direction of the designated target relative to the optical axis. The computer-readable memory is encoded with instructions that, when executed by the one or more processors, cause the system to illuminate, using the target illuminator, the designated target during an illumination time offset by a Phase Offset Interval (POI) from the exposure time period.

DETAILED DESCRIPTION

Apparatus and associated methods relate to a dual-mode seeker for a guided missile equipped with seeker/designation handoff capabilities. The dual-mode seeker has Semi-Active Laser (SAL) and Image InfraRed (IIR) modes of operation. SAL-mode operation includes detecting laser pulses reflected by a target designated by a remote Laser Target Designator (LTD) and determining target direction using the detected laser pulses. SAL-mode operation also includes determining the Pulse Repetition Interval (PRI) of the detected laser pulses, and predicting timing of future pulses generated by the LTD. IIR-mode operation includes capturing Short-Wavelength InfraRed (SWIR) images of a scene containing the designated target and determining target location using one or more image features associated with the designated target. After the target direction can be determined using the IIR-mode of operation, an illuminator projects a signal onto the designated target so as to communicate to a remote operator that LTD target designation can be suspended.

Figure 1:
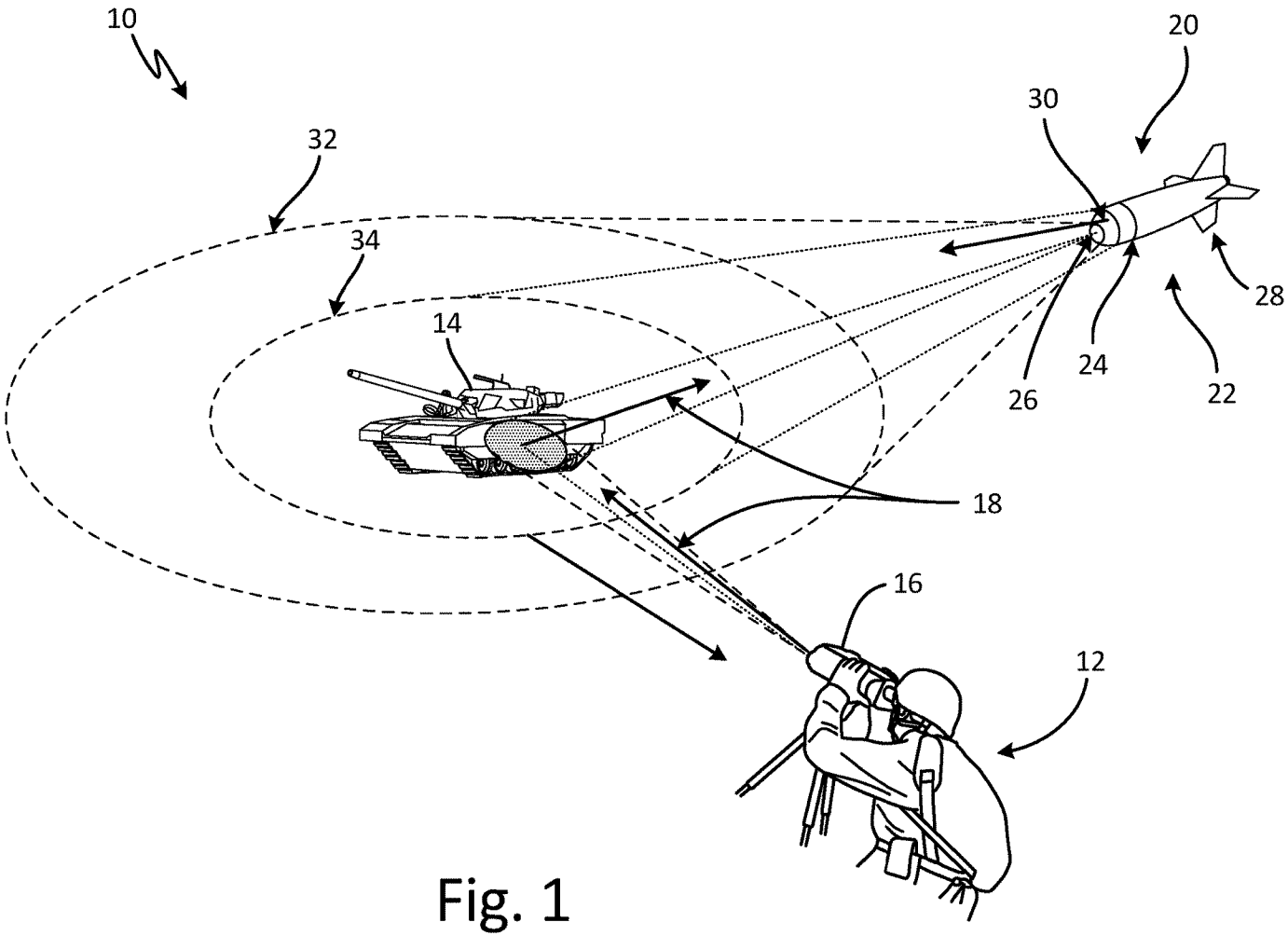
FIG. 1 is a schematic diagram of an exemplary scenario in which seeker/designator handoff communications are conducted between a precision guided weapon and a laser target designator.

FIG. 1 is a schematic diagram of an exemplary scenario in which seeker/designator handoff communications are conducted between a precision guided weapon and a laser target designator. In exemplary scenario 10, as depicted in FIG. 1, forward observer 12 is "painting" or designating target 14 using laser target designator (LTD) 16 to provide targeting signal 18 (e.g., laser radiation) that can be received by precision guided weapon 20. Precision guided weapon 20 can be launched, for example, from the ground, sea, or air. Precision guided weapon 20 has seeker 22, which guides precision guided weapon 20 to a location (e.g., designated target 14) from which targeting signal 18 reflects. Seeker 22 has SAL target locator 24 and IIR target locator 26 which can interface with airfoil control system 28 of precision guided weapon 20. Seeker 22 also has target illuminator 30 aligned with IIR target locator 26 and SAL target locator 24, so as to be able to illuminate designed target 14 when seeker 20 is locked upon designated target 14.

In some embodiments, LTD 16 paints or designates target 14 with electromagnetic energy that is invisible to the human eye. For example, a SWIR laser may be projected onto target 14, designating target 14 as the terminal destination for precision guided weapon 20. In some embodiments, LTD 16 may designate target 14 using a pulsed and/or encoded pattern of laser pulses. SAL target locator 24 detects the pulsed or encoded targeting signal 18 reflected by designated target 14. In some embodiments, SAL target locator 24 uses a spectral light filter that corresponds to a light spectrum of targeting signal 18 generated by LTD 16. SAL target locator 24 can then identify the pattern sequence of detected targeting signal 18 to determine if targeting signal 18 originated from LTD 16. If SAL target locator 24 identifies detected targeting signal 18 as originating from LTD 16 in this way, then SAL target locator 24 can predict a timing of a next pulse and/or future laser pulses in the encoded targeting signal 18.

In some embodiments, when guided missile 20 approaches designated target 14, seeker 22 can switch to IIR-mode of operation. In the IIR-mode of operation, IIR target locator 26 can capture images of scene 32 that includes designated target 14. IIR target locator 26 can associate features of designated target 14 with designated target 14. Such associated features might have distinctive image characteristics, for example, so that an image processor can readily identify such associated features within the captured images of scene 32. IIR target locator 26 can then use the image coordinates of these associated features within the captured images to determine a direction of designated target 14 relative to guided missile 20.

SAL target locator 24 and IIR target locator 26 operate in conjunction with airfoil control system 28 to provide closed-loop guidance control of precision guided weapon 20. Closed-loop guidance control can include a repetition of various steps. For example, a first step can involve SAL target locator 24 detecting a sequence of SWIR pulses generated by LTD 16 and reflected by designated target 14. In this step, SAL target locator 24 detects targeting signal 18, identifies a sequence pattern, determines if the identified sequence pattern corresponds to LTD 16, and predicts the future timing of a next pulse in the identified sequence of SWIR pulses.

A second step can involve, for example, using the detected pulses to determine a direction of designated target 14 relative to guided missile 20. Various types of SAL target locators 24 can be used, and various means of determining the relative direction of designated target 14 can be performed. For example, some SAL target locators 24 can have a quadrature light detector. Relative signal strength from the four quadrants of the quadrature light detector can be used to determine the direction from which targeting signal 18 is reflected. In some embodiments, a focal plane array can be used by SAL target locator 24. Scene 32, which includes designated target 14, can be imaged onto the focal plane array. Image coordinates corresponding to the imaged target signal 18 can be used to determine a relative direction of designated target 14. In an exemplary embodiment, SAL target locator 24 and IIR target locator 26 can share a focal plane array.

A third step can involve, for example, orienting guided missile 20 in the determined direction of designated target 14. In this step, airfoil control system 28 adjusts the physical orientation of one or more airfoils to aim the missile in the direction determined by SAL target locator 24. In some embodiments, aiming guided missile 20 will simultaneously center laser designator signal 18 within a field of view of SAL target locator 24 and/or IIR target locator 26. In this way, aiming the missile closes the loop by centering laser designator signal 18 within the field of view of the SAL target locator 24, which again detects the next pulse in the sequence of SWIR pulses projected onto target 14 by LTD 16. When guided missile 20 is oriented in the direction of designated target 14, guided missile 20 is "locked onto" designated target 14.

A fourth step can involve, for example, SAL target locator 24 controlling an image exposure timing of IIR target locator 26 so as to capture an image of desired target 14. The exposure timing of IIR target locator 26 is controlled such that designated target 14 is not being illuminated by a laser pulse generated by LTD 16 and therefore the next image captured by IIR target locator 26 will include scene 32 as passively illuminated. In this step, the captured image can be used to identify image features corresponding to designated target 14.

IIR target locator 26 can identify image features that correspond to designated target 14. For example, IIR target locator 26 can select image features proximate to the image coordinates corresponding to an image location at which targeting signal 18 would be imaged. In some embodiments, the image location at which targeting signal 18 would be imaged, for example, can be the center of the focal plane array when guided missile 20 is locked onto designated target 14. Two or more of such proximate image features can be used to triangulate and/or establish a target location corresponding to the targeting signal 18. After seeker 22 can determine target location using passive images, target designation by LTD 16 can be suspended, and seeker 22 can locate target using only the IIR mode of operation.

In some embodiments, SAL target locator 24 is oriented such that the SWIR energy detected by SAL target locator 24 originates from scene 32, which can also be imaged by IIR target locator 26. In some embodiments, axially aligning SAL target locator 24 parallel to an optical axis of a lens stack of IIR target locator 26 can result in alignment of scene 32. Such alignment can enable seeker 22 to both detect targeting signal 18 for use by SAL target locator 24 and capture images of scene 32 for use by IIR target locator 26. In some embodiments, both SAL target locator 24 and IIR target locator 26 can be axially aligned with precision guided weapon 20. In some embodiments, a gimbaled telescope assembly may permit SAL target locator 24 and IIR target locator 26 to be pointed independently of an axis of precision guided weapon 20.

A fifth step can involve, for example, illuminating designated target 14 by seeker 20 so as to communicate to forward observer 12 that target designation by LTD 16 can be suspended. Target illuminator 30 is aligned to SAL target locator 24 and/or IIR target locator 26 (e.g., in a parallel and/or coaxial fashion). With such an alignment, target illuminator 30 is configured to project target illumination signal 34 upon designated target 14. Target illuminator 30 can project target illumination signal for various purposes. Target illuminator 30 can be used to illuminate designated target 14 for communications purposes, such as, for example, as a handoff signal to communicate to the forward observer that target illumination can be suspended. In some embodiments, target illuminator 30 can project target illumination signal 34 at a Pulse Offset Interval (POI) from the PRI of targeting signal 18 projected by LTD 16. LTD 16 can be equipped with a camera that is capable of detecting handoff signal 34. When target illumination signal 34 is detected by LTD 16, forward operator 12 can suspend the designation of target 14 by LTD 16. In some embodiments, target illuminator 30 can be used to illuminate designated target 14 to provide active illumination of designated target 14 during image capture of scene 32 in the IIR mode of operation.

In some embodiments, communications can also be initiated by LTD 16 and received by guided missile 20. For example, LTD 16 can project communications pulses in addition to the tracking pulses onto designated target 14. Communications pulses can be timed at various intervals and/or in various pattern sequences to communication information to guided missile 20. For example, an abort command and/or a retargeting command can be issued by projecting laser pulses at various intervals and/or of various pattern sequences. Guided missile 20 can use SAL target locator 24 to detect such communications. SAL target locator 24 can be used in this manner independently of which mode of operation seeker 22 is using. If commanded to retarget, for example, seeker 22 can transition from IIR mode of operation back to SAL mode of operation to acquire the new target.

Figure 2:
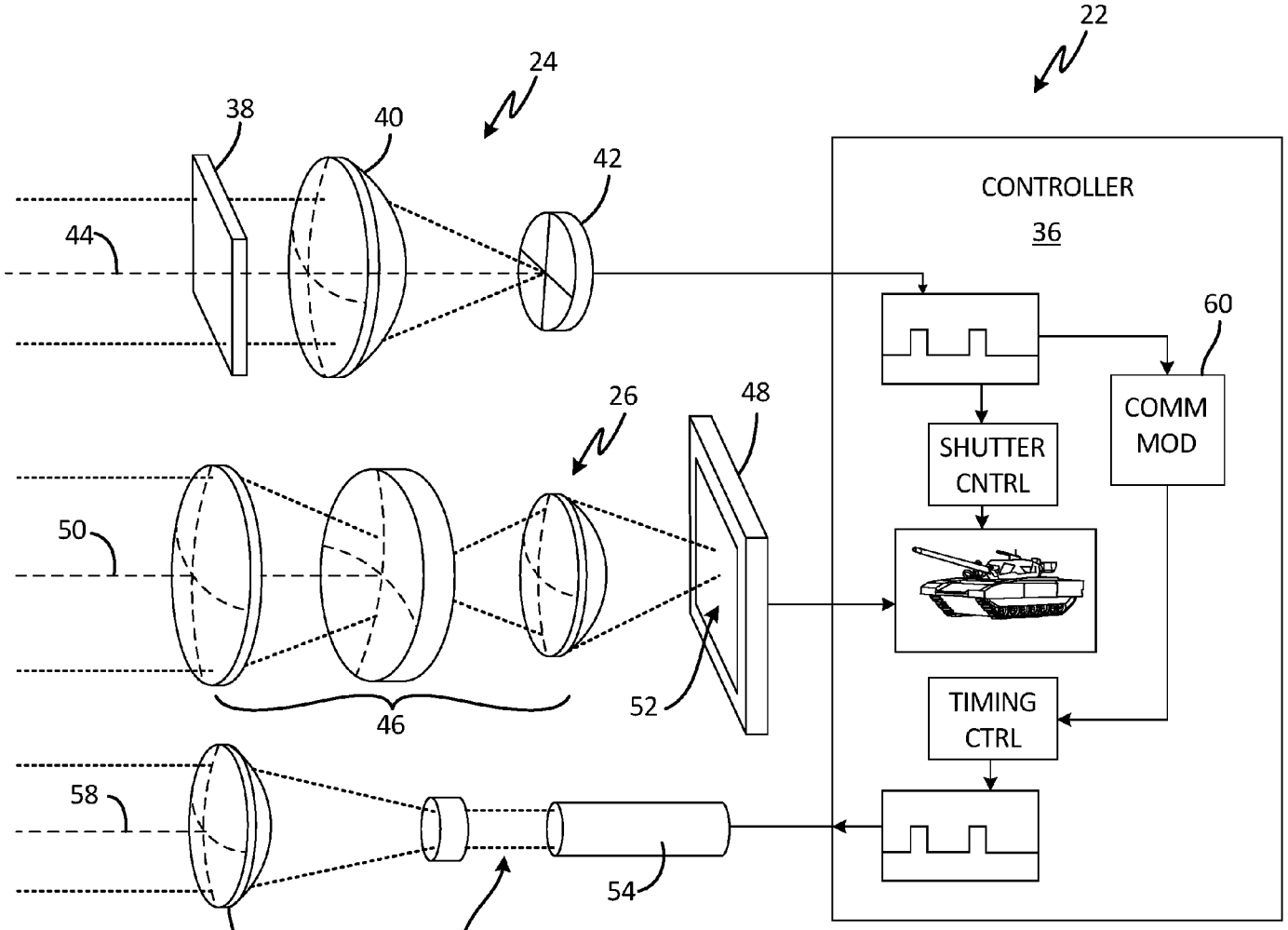
FIG. 2 is a schematic diagram of an exemplary dual-mode seeker equipped with seeker/designator handoff capabilities.

FIG. 2 is a schematic diagram of an exemplary dual-mode seeker equipped with seeker/designator handoff capabilities. In FIG. 2, seeker 22 has SAL target locator 24, IIR target locator 26, target illuminator 30, and controller 36. SAL target locator 24 includes optical filter 38, SWIR collecting lens 40, and SWIR quadrature detector 42. In some embodiments, optical filter 38 is a bandpass filter to limit the optical loading of SWIR quadrature detector 42 to only frequencies corresponding to targeting beam 18 (depicted in FIG. 1). SWIR collecting lens 40 and/or a center of SWIR quadrature detector 42 can define optical axis 44 of SAL target locator 24.

Controller 36 can receive an output signal from SWIR quadrature detector 42. Controller 36 can then detect a sequence of SWIR pulses, based on the received output signal. Controller 36 can compare the detected sequence of SWIR pulses with a predetermined pattern. If the detected sequence of SWIR pulses does not correspond to the predetermined pattern associated with LTD 16 (depicted in FIG. 1), the detected sequence of SWIR pulses is not used to predict a timing of the next pulse. If the detected sequence of SWIR pulses does correspond to the predetermined pattern associated with LTD 16, controller 36 can predict a timing of the next pulse of the predetermined pattern. Controller 36 can generate an output signal indicative of the predicted timing of the next pulse. Such an output signal can be use, for example, to control a timing of image exposure for IIR target locator 26.

IIR target locator 26 has optical lens stack 46 and focal plane array 48. Optical lens stack 46 is configured to receive SWIR light from a scene aligned along optical axis 50 and is configured to focus at least a portion of the received SWIR light onto imaging region 52 of focal plane array 48, thereby forming images of the aligned scene (such as, e.g., scene 32 depicted in FIG. 1). Such images include pixel data of focal plane array 48. Optical axis 50 of IIR target locator 26 is aligned parallel to optical axis 44 of SAL target locator 24 such that designated target 14 (depicted in FIG. 1) can be both detected by SAL target locator 24 and imaged by IIR target locator 26.

In some embodiments IIR target locator 26 is further configured to receive energy from a field of view that is substantially equal to a field of view detected by SAL target locator 24. In this way, whenever SWIR quadrature detector 42 detects a sequence of SWIR pulses generated by LTD 16 and reflected by the scene, IIR target locator 26 can image that same scene in which target 14 is designated by LTD 16. Imaging of the scene by IIR target locator 26 can be performed coordinated with detection of SWIR pulses by SAL target locator 24.

Controller 36 can control the exposure and/or shutter timing of IIR target locator 26 such that an image can be generated at a predicted timing with respect to the timing of the laser pulses in the detected sequence of targeting signal 18. In some embodiments images are captured at timings between adjacent laser pulses generated by LTD 16. In some embodiments, images are captured at timings coincident with laser pulses generated by LTD 16. Comparing images obtained at timings between laser pulses and images obtained at timings coincident with laser pulses of targeting beam 18 (depicted in FIG. 1) can facilitate a determination of pixel coordinates corresponding to targeting beam 18. For example, a difference between images that include laser pulses of targeting beam 18 and images that do not include laser pulses of targeting beam 18 can be used to determine the pixel coordinates corresponding to targeting beam 18.

Various embodiments can use various methods to control exposure of images captured by IIR target locator 26. For example, in some embodiments, exposure can be controlled by a physical shutter. In other embodiments, exposure can be controlled electronically. Electronic control of exposure can sometimes be called electronic shutter control. Timing control of exposure can similarly be called shutter timing control.

In some embodiments, seeker 22 can provide a signal indicative of the target location to airfoil control system 28 of guided missile 20. The signal indicative of the target location can be generated based on the target location as determined by SAL target locator 24 and/or IIR target locator 26. For example, in a SAL-mode of operation, an output signal from SWIR quadrature detector 42 can be provided to the airfoil control system 28. In an IIR-mode of operation, the image coordinates of the designated target can be provided to airfoil control system 28.

Target illuminator 30 includes optical source 54 and collimating lens 56. Optical source 54 and collimating lens 56 define optical axis 58 of target illuminator 30. Optical axis 58 of target illuminator 30 is aligned parallel to optical axis 44 of SAL target locator 24 and/or parallel to optical axis 50 of IIR target locator 26. If optical axis 58 of target illuminator 30 is parallel to optical axis 50 of IIR target locator 26, then optical illuminator 30 is configured to illuminate the scene aligned along optical axis 50 of IIR target locator 26. An image of the aligned scene can then be captured by focal plane array 52 of IIR target locator 26.

Controller 36 includes communications module 60. Communications module 60 can interpret, based on the received sequence of laser pulses, communications from LTD 16. Communications module 60 can control target illuminator 30 to generate pulses of illumination indicative of communications to LTD 16. Various timings of pulses and/or sequence patterns of pulses of illumination can be used to communication a variety of things between LTD 16 and seeker 22. Such variety of communications can include commands from/to LTD 16, and/or flight information of guided missile 20, and/or targeting information, for example.

Figure 3:
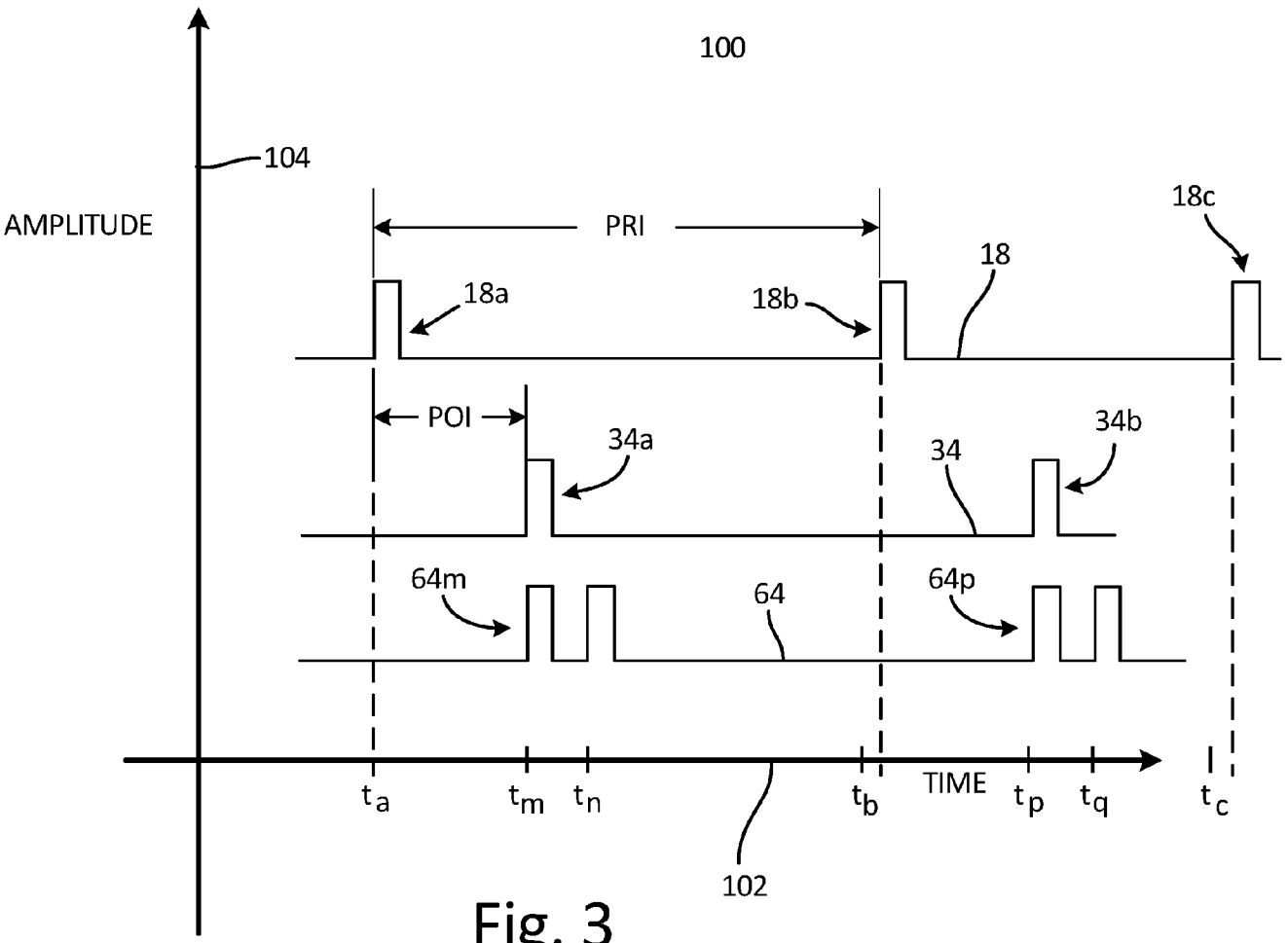
FIG. 3 depicts a timing diagram of a detected sequence of laser target designator pulses and illumination pulses projected upon the target by a guided missile.

FIG. 3 depicts a timing diagram of a detected sequence of laser target designator pulses and illumination pulses projected upon the target by a guided missile. In FIG. 3, timing diagram 100 includes horizontal axis 102 and vertical axis 104. Horizontal axis 102 represents a time base, and vertical axis 104 is indicative of amplitude of detected and projected SWIR pulses. Vertical axis 104 is also indicative of image exposure control of IIR target locator 26. Timing diagram 100 includes targeting signal 18, target illumination signal 34, and shutter timing control signal 64.

Targeting signal 18 includes a sequence of laser pulses 18*a*, 18*b* detected by SAL target locator 24 (depicted in FIGS. 1-2). Pulses 18*a*, 18*b* occur at times $t_a$, $t_b$, respectively. The relative times $t_a$, $t_b$ may be indicative of a sequence pattern and/or code associated with LTD 16. Controller 36 (depicted in FIG. 2) can compare the times $t_a$, $t_b$ of detected pulses 18*a*, 18*b*, respectively, with a sequence pattern associated with LTD 16, for example. If the timing sequence of detected pulses 18*a*, 18*b* corresponds to the sequence pattern associated with LTD 16, controller 36 can identify the sequence pattern as originating from LTD 16. Controller 36 can then predicts a timing $t_c$ of next pulse 18*c* in the identified sequence pattern.

Controller 36 can also control timing of target illumination pulses 34*a*, 34*b* by target illuminator 30 (depicted in FIGS. 1-2). Target illuminator 30 can produce illumination pulses 34*a*, 34*b* at a Pulse Offset Interval (POI) from the PRI of targeting signal 18. LTD 16 may have a SWIR camera that images the aligned scene. If LTD 16 detects illumination pulses 34*a*, 34*b* at the POI indicative of seeker 22 achieving an ability to track designated target 14 using an IIR mode operation, LTD 16 can provide an indicator signal to the forward observer that target designation can be suspended. In some embodiments, the timing of the POI can be indicative of various commands. In some embodiments, a pulse code can be indicative of a communication command or a seeker condition.

Controller 36 can also inform IIR target locator 26 of the predicted time $t_c$ of next pulse, for use in coordinating image exposure with target illumination of the aligned scene. For example, controller 36 can generate shutter timing control signal 64 such that the images are captured at time $t_m$, $t_n$, $t_p$, $t_q$. At times $t_m$, $t_p$, shutter timing control signal 64 includes timing pulses 64*m*, 64*p* respectively. Timing pulses 64*m*, 64*p* are coincident with illumination pulses 34*a*, 34*b*, respectively. Thus, images captured at times $t_m$, $t_p$ will be actively illuminated by target illuminator 30. In some embodiments, active illumination of the aligned scene can advantageously enable lowlight seeker operations. In some embodiments, active illumination of the aligned scene can provide consistent imaged features corresponding to the designated target. Such consistent imaged features can advantageously make target tracking more robust across a variety of lighting conditions.

In some embodiments, LTD 16 can generate laser pulses for communication commands and/or status information to guided missile 22. For example, LTD 16 can provide a laser pulse at a second POI after the target illumination pulse from seeker 22. The second POI can be indicative of a command from and/or a status of the LTD, for example. In some embodiments, a pulse sequence pattern can encode such commands and/or status information. These communicated commands and/or status information can then be detected by SAL target locator 24 and then interpreted by controller 36.

Figure 4:
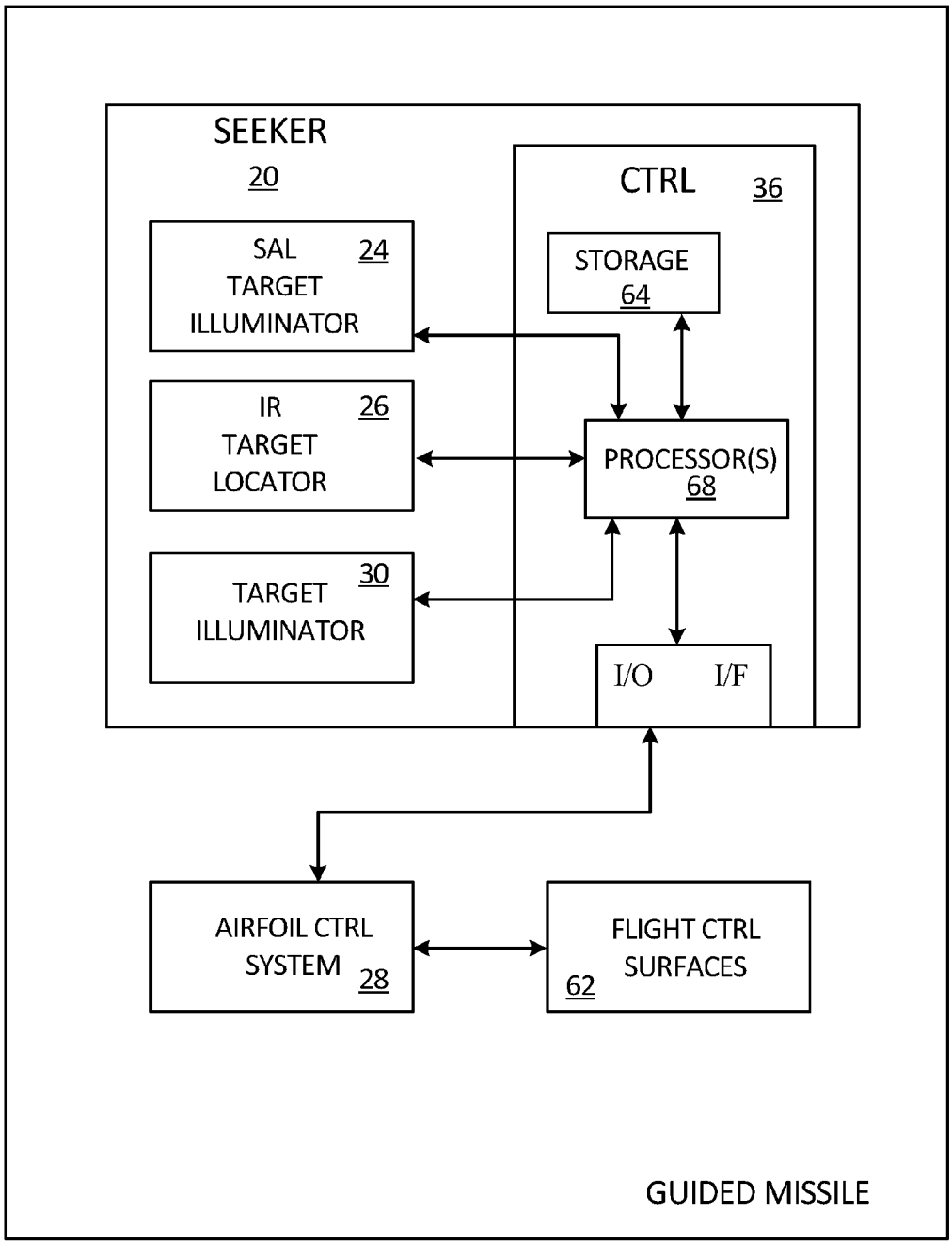
FIG. 4 is a block diagram of an exemplary dual-mode seeker having target illumination capability.

FIG. 4 is a block diagram of an exemplary dual-mode seeker having target illumination capability. In FIG. 4, precision guided weapon 20 includes flight control surfaces 62, airfoil control system 28 and seeker 22 having SAL target locator 24, IIR target locator 26, target illuminator 30, and controller 36. Controller 36 can be any device capable of executing computer-readable instructions defining a software program capable of locating a designated target from the vantage of precision guided missile 20. Examples of controller 36 can include, but are not limited to, an avionics unit configured for use on a missile.

As illustrated in FIG. 4, controller 36 has storage device(s) 64, input/output interface 66 and processor(s) 68. However, in certain examples, seeker 22 can include more or fewer components. Processor(s) 68, in one example, are configured to implement functionality and/or process instructions for execution within seeker 22. For instance, processor(s) 68 can be capable of processing instructions stored in storage device(s) 64. Examples of processor(s) 68 can include any one or more of a microprocessor, a controller, a digital signal processor (DSP), an application specific integrated circuit (ASIC), a field-programmable gate array (FPGA), or other equivalent discrete or integrated logic circuitry.

Processor(s) 68 interface with SAL target locator 24, IIR target locator 26, and/or target illuminator 30. In some embodiments, processor(s) 68 may identify a pattern sequence in the laser pulses detected by SAL target locator 24. Processor(s) 68 may associate the identified sequence with LTD 16. Processor(s) 68 may predict a timing of a future pulse in the identified sequence. Processor(s) 68 may perform shutter timing control, based on the predicted timing of the next pulse, of IIR target locator 26, in some embodiments. In some embodiments, processor(s) 68 may perform image processing algorithms on images generated by IIR target locator 26. For example, processor(s) 68 may identify image features corresponding to designated target 14 (depicted in FIG. 1).

Storage device(s) 64 can be configured to store information within seeker 22 during operation. Storage device(s) 64, in some examples, is described as computer-readable storage media. In some examples, a computer-readable storage medium can include a non-transitory medium. The term "non-transitory" can indicate that the storage medium is not embodied in a carrier wave or a propagated signal. In certain examples, a non-transitory storage medium can store data that can, over time, change (e.g., in RAM or cache). In some examples, storage device(s) 64 is a temporary memory, meaning that a primary purpose of storage device(s) 64 is not long-term storage. Storage device(s) 64, in some examples, is described as volatile memory, meaning that storage device(s) 64 does not maintain stored contents when power to seeker 22 is turned off. Examples of volatile memories can include random access memories (RAM), dynamic random access memories (DRAM), static random access memories (SRAM), and other forms of volatile memories. In some examples, storage device(s) 64 is used to store program instructions for execution by processor(s) 68. Storage device(s) 64, in one example, is used by software or applications running on seeker 22 (e.g., a software program implementing designated target detection) to temporarily store information during program execution.

Storage device(s) 64, in some examples, also includes one or more computer-readable storage media. Storage device(s) 64 can be configured to store larger amounts of information than volatile memory. Storage device(s) 64 can further be configured for long-term storage of information. In some examples, storage device(s) 64 includes non-volatile storage elements. Examples of such non-volatile storage elements can include magnetic hard discs, optical discs, flash memories, or forms of electrically programmable memories (EPROM) or electrically erasable and programmable (EEPROM) memories. Storage device(s) 64 can include program segments, pulse detector segments, pattern sequence recognition segments, and image processing segments, etc.

Seeker 22 also includes input/output interface 66. In some embodiments, input/output interface 66 can utilize communications modules to communicate with external devices via one or more networks, such as one or more wireless or wired networks or both. Input/output interface 66 can be a network interface card, such as an Ethernet card, an optical transceiver, a radio frequency transceiver, or any other type of device that can send and receive information. Other examples of such network interfaces can include Bluetooth, 3G, 4G, and WiFi radio computing devices as well as Universal Serial Bus (USB).

Figure 5:
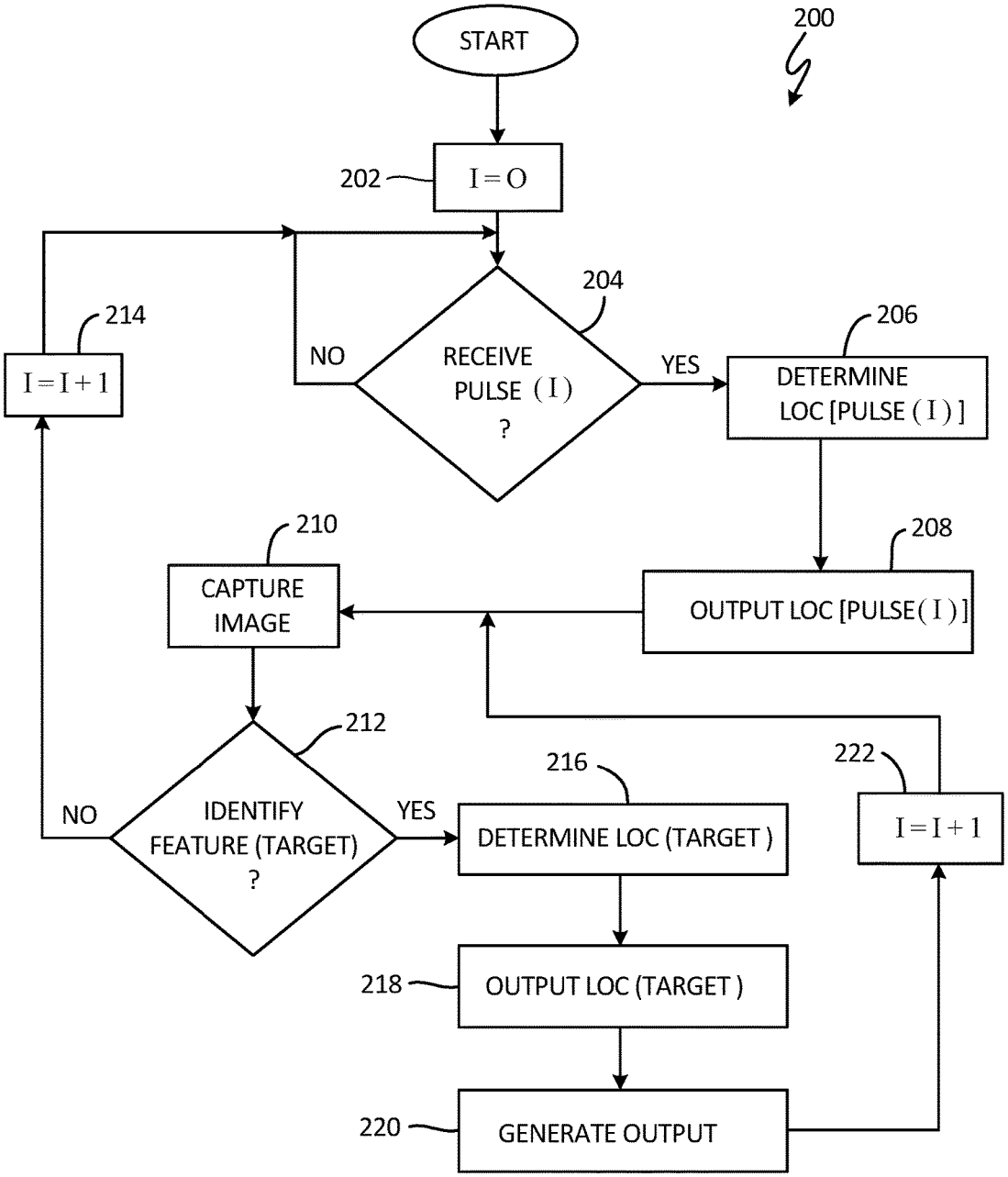
FIG. 5 is a flowchart of an exemplary method for locating a target using a dual-mode seeker equipped with seeker/designation handoff capabilities.

FIG. 5 is a flowchart of an exemplary method for locating a target using a dual-mode seeker equipped with seeker/ designation handoff capabilities. In FIG. 5, method 200 is depicted from the vantage point of processor(s) 68 of FIG. 4. Method 200 begins at step 202 where processor(s) 68 initializes index I. Then method 200 proceeds to step 204, where processor(s) 68 waits for detection of a next pulse by SAL target locator 26. Method 200 remains at step 204 until a next pulse is detected. When the next pulse is detected, method 200 proceeds to step 206, where processor(s) 68 determines a location of the pulse within SWIR quadrature detector 42. Then, method 200 proceeds to step 208, where processor(s) 68 outputs a signal indicative of the determined location to airfoil control system 28. Then at step 210, processor(s) 68 receives an image captured by IIR target locator 26. Then, at step 212, processor(s) 68 identifies image features associated with designated target 14. If, at step 212, processor(s) 68 is not successful in identifying image features associated with designated target 14, method 200 proceeds to step 214, where index, I, is incremented, and then method 200 returns to step 204 where processor(s) 68 waits for detection of a next pulse by SAL target locator 26. If, however, at step 212, processor(s) 68 is not successful in identifying image features associated with designated target 14, then method 200 proceeds to step 216 where processor(s) 68 determines image coordinates corresponding to designated target 14. Then, method 200 proceeds to step 218, where processor(s) 68 outputs a signal indicative of the determined image coordinates to airfoil control system 28. Method 200 then proceeds to step 220, where processor(s) 68 commands target illuminator 30 to generate a pulse of illumination. Then processor(s) 68 increments index, I, at step 222 and method 200 returns to step 210, where processor(s) 68 receive an image captured by IIR target locator 26.

Figure 6:
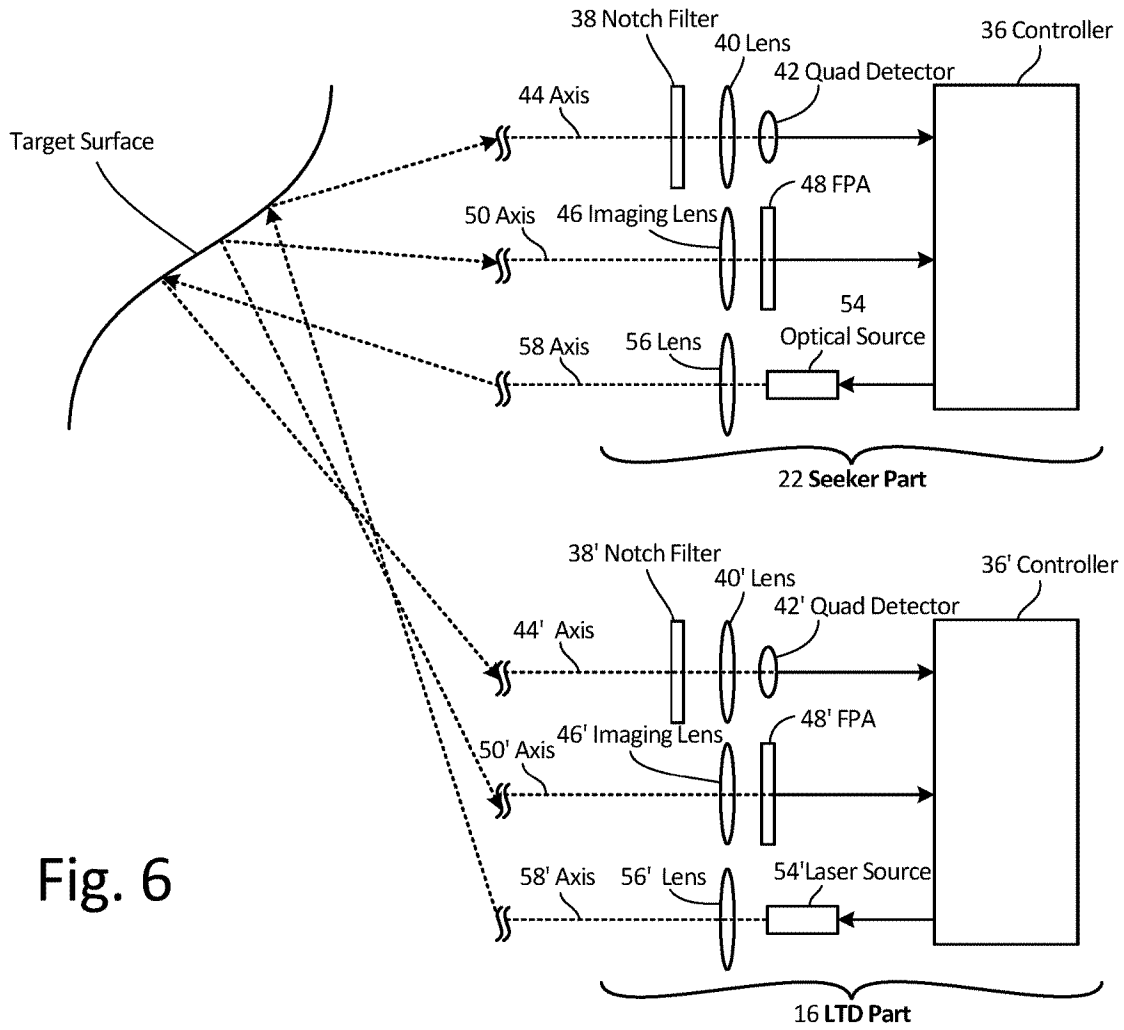
FIG. 6 is a schematic diagram depicting various symmetries between an exemplary dual-mode seeker and its paired laser target designator.

FIG. 6 is a schematic diagram depicting various symmetries between an exemplary dual-mode seeker and its paired laser target designator. In FIG. 6, dual-mode seeker 22 is depicted with its paired LTD 16. Dual mode seeker 22 and LTD 16 are configured to bidirectionally communicate therebetween. Various symmetries are depicted in the FIG. 6 embodiment. For example, both dual mode seeker 22 and LTD 16 include controller 36 36', respectively. Both dual mode seeker 22 and LTD 16 include quad detectors 42 42', respectively, along with optical elements: notch filter 38 38' and lens 40 40' respectively. Both dual mode seeker 22 and LTD 16 include imaging components: FPA 48 48' and imaging lens 46 46', respectively. Both dual mode seeker 22 and LTD 16 include target illuminator elements: optical source 54 54', and lens 56 56', respectively. These symmetries can facilitate bidirectional communication between dual mode seeker 22 and LTD 16. Because LTD 16 and dual mode seeker 22 each transmit and receive communications from the other, both LTD 16 and dual mode seeker 22 are equipped to perform both transmission and reception.

Dual mode seeker 22 and LTD 16 need not have perfect symmetry in every embodiment. For example, optical source 54' of LTD 16 can be a laser in some embodiments. Such a laser source 54' can provide a precise target designation as laser source 54' illuminates the designated target using a collimated beam of energy. Dual mode seeker 22 may illuminate the target using one of a variety of types of optical sources. Dual mode seeker 22 need not provide precise target designation, but illuminates the designated target for communications purposes. Thus, optical source 54 of dual mode seeker 22, may be a laser, in some embodiments, but can be a light emitting diode or another illumination source in other embodiments.

Dual mode seeker 22 is configured to perform various functions. For example, some dual mode seekers 22 are configured to: i) synchronize itself with laser pulses having a predetermined PRI; ii) determine direction of predetermined PRI laser pulses reflected from designated target 14 (depicted in FIG. 1); iii) image designated target 14; iv) identify image locations corresponding to target locations from which predetermined PRI laser pulses reflect; v) determine image features corresponding to target 14 designated by predetermined PRI laser pulses; and vi) determine direction of target based on image location of determined image features corresponding to designated target 14.

Figure 7:
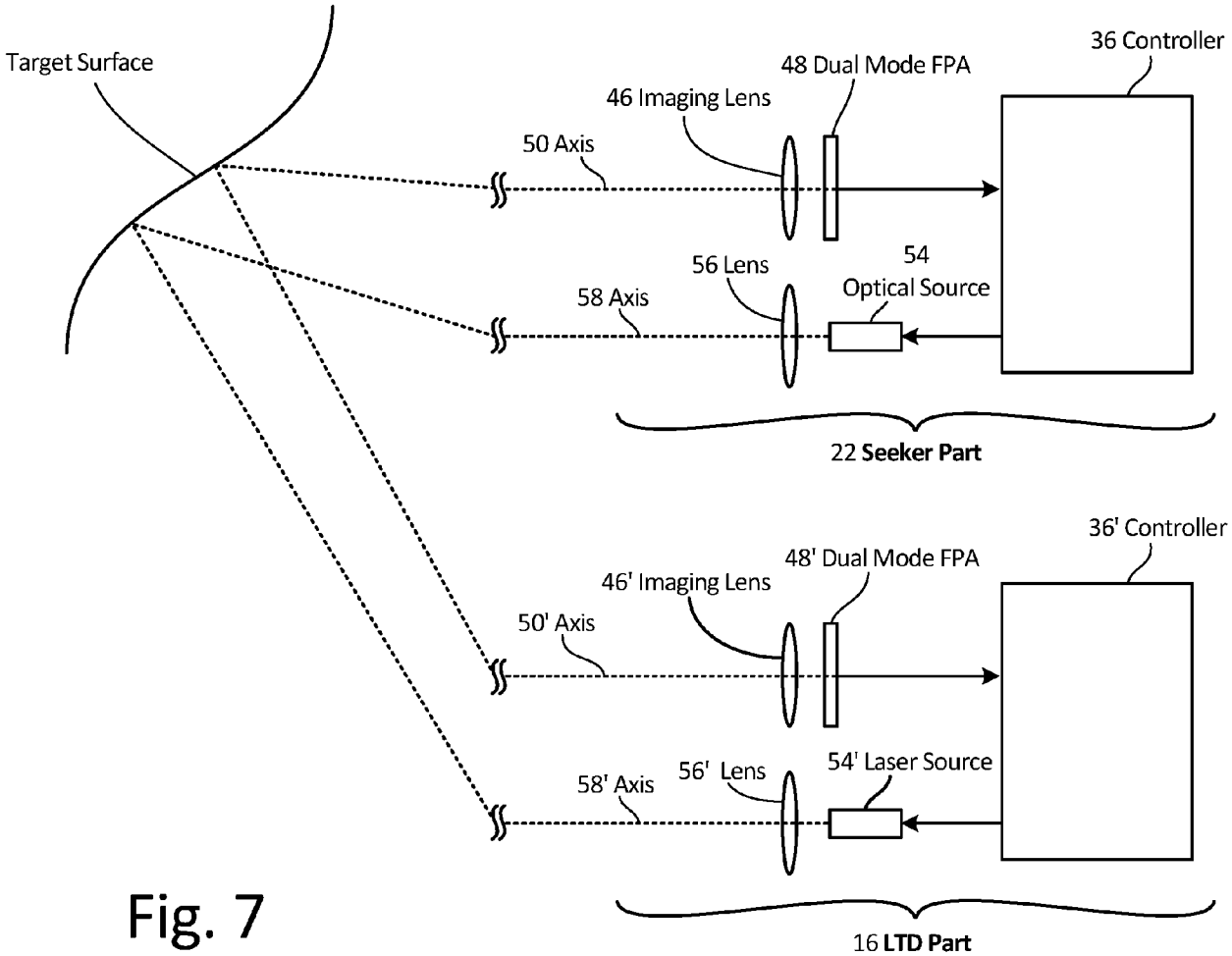
FIG. 7 is a schematic diagram depicting an alternate embodiment of a dual-mode seeker and its paired laser target designator.

FIG. 7 is a schematic diagram depicting an alternate embodiment of a dual-mode seeker and its paired laser target designator. The FIG. 7 embodiment may use a different hardware/software configuration to perform functions i)-vi) described above with respect to the FIG. 6 embodiment. In the FIG. 7 embodiment, the functions performed by quad detectors 42 42' are performed by dual mode FPA 48 48' and controller 36 36'. In the FIG. 7 configuration, shutter control for dual mode FPA 48 48' can be made so as to obtain images at times that coincide with target designation by LTD 16. Target location can be performed by identifying the image location corresponding to the imaged PRI laser pulses, for example.

The following are non-exclusive descriptions of possible embodiments of the present invention.

Apparatus and associated devices relate to a dual-mode seeker for a guided missile. The dual-mode seeker includes a first-mode target locator, a second-mode target locator and an active Short-Wavelength InfraRed (SWIR) target illuminator. The first-mode target locator is configured to detect laser pulses reflected by a target within a scene aligned along an optical axis of the dual-mode seeker. Each of the laser pulses is projected onto the target by a remote Laser Target Designator (LTD), thereby designating the target. The first-mode target locator is further configured to determine, based on the detected laser pulses, a direction of the designated target relative to the optical axis. The first-mode target locator is further configured to generate an output signal indicative of the direction of the designated target relative to the optical axis. The second-mode target locator is configured to capture Short-Wavelength InfraRed (SWIR) images of the aligned scene. Each of the SWIR images is captured at an exposure time period in which the remote LTD is not projecting a laser pulse onto the designated target. The second-mode target locator is further configured to identify an image feature corresponding to the designated target within each of the SWIR images. The second-mode target locator is further configured to determine, based on the identified image feature, the direction of the designated target relative to the optical axis. The second-mode target locator is further configured to generate an output signal indicative of the direction of the designated target relative to the optical axis. The active SWIR illuminator is aligned with the optical axis and configured to illuminate the designated target during an illumination time offset by a Phase Offset Interval (POI) from the exposure time period.

A further embodiment of the foregoing dual-mode seeker, wherein illuminating the designated target during the illumination time period offset by the POI from the exposure time period can be detectable by the remote LTD to indicate that the dual-mode seeker has identified the image feature corresponding to the designated target.

A further embodiment of any of the foregoing dual-mode seekers, wherein the designated target can be illuminated by the active SWIR illuminator during the exposure time period of at least one of the SWIR images.

A further embodiment of any of the foregoing dual-mode seekers, wherein the first-mode target locator can be further configured to identify, based on the detected laser pulses, a Pulse Repetition Interval (PRI) at which the remote LTD projects the laser pulses onto the target within the scene.

A further embodiment of any of the foregoing dual-mode seekers, wherein the first-mode target locator can be further configured to interpret, based on the identified PRI, communications from the LTD.

A further embodiment of any of the foregoing dual-mode seekers, wherein the first-mode target locator can be further configured to generate, based on the interpreted communications, an abort command or a retargeting command.

A further embodiment of any of the foregoing dual-mode seekers, wherein the first-mode target locator can be further configured to predict, based on the detected laser pulses, a time interval corresponding to a future laser pulse projected by the remote LTD of the designated target within the aligned scene.

A further embodiment of any of the foregoing dual-mode seekers, wherein the second-mode target locator can be further configured to continue, after identifying the image feature within each of the SWIR images, the capturing, identifying, determining and generating steps of the second-mode target locator in a repetitious fashion.

Some embodiments relate to a Laser Target Designator (LTD) for a guided missile. The LTD includes a laser and a Short-Wavelength InfraRed (SWIR) camera. The laser is configured to project laser pulses onto a target aligned along a laser axis, thereby designating the target. The laser pulses are projected at a Pulse Frequency Rate (PFR). The SWIR camera is configured to capture SWIR images of a scene aligned along the laser axis. The SWIR camera is further configured to detect SWIR illumination pulses of the designated target by a target illuminator of a guided missile. The SWIR camera is also configured to identify a Pulse Offset Interval (POI) between the projected laser pulses and the detected SWIR illumination pulses.

A further embodiment of the foregoing LTD, wherein the SWIR camera can be further configured to generate an output signal indicative that the POI corresponds to a predetermined interval.

A further embodiment of any of the foregoing LTDs, wherein the SWIR camera can be further configured to display, on a display screen, indicia indicative the detected SWIR illumination pulses.

A further embodiment of any of the foregoing LTDs, wherein the laser can be further configured to project secondary laser pulses onto the aligned target at a Secondary Offset Interval (SOI) between the detected SWIR illumination pulses and the projected secondary laser pulses.

A further embodiment of any of the foregoing LTDs, wherein projecting secondary laser pulses can be indicative of a retargeting command or an abort command.

Some embodiments relate to a method of tracking a target for a guided missile. The method includes projecting laser pulses onto a target, thereby designating the target. The method includes detecting laser pulses reflected by a designated target. The method includes determining, based on the detected laser pulses, a direction of the designated target. The method includes generating an output signal indicative of the direction of the designated target. The method includes capturing SWIR images of a scene that includes the designated target. Each of the SWIR images is captured at an exposure time period in which laser pulses are not being projected onto the designated target. The method includes identifying an image feature within each of the SWIR images. The identified image feature correspond to the designated target. The method includes determining, based on the identified image feature, the direction of the designated target. The method includes generating an output signal indicative of the direction of the designated target. The method includes illuminating the designated target during an illumination time offset by a POI from the exposure time period.

A further embodiment of the foregoing method, wherein illuminating the designated target during the illumination time period offset by the POI from the time period corresponding to the detected laser pulses can communicate to a remote Laser Target Detector (LTD) that the image feature corresponding to the designated target has been identified.

A further embodiment of any of the foregoing methods, wherein the illumination time period can coincide with the exposure time period.

A further embodiment of any of the foregoing methods, further including identifying, based on the detected laser pulses, a Pulse Repetition Interval (PRI) at which a remote LTD designates the target within the scene.

A further embodiment of any of the foregoing methods, further including interpreting, based on the identified PRI, communications from the LTD.

A further embodiment of any of the foregoing methods, further including generating, based on the interpreted communications, an abort command or a retargeting command.

A further embodiment of any of the foregoing methods, further including predicting, based on the detected laser pulses, a time interval corresponding to a next designation by a remote LTD of the designated target within the aligned scene.

Some embodiments relate to a system for tracking a target for a guided missile. The system includes a laser-pulse detector configured to detect laser pulses reflected by a target within a scene aligned along an optical axis. Each of the laser pulses is projected onto the target by a remote LTD thereby designating the target. The system includes a SWIR camera configured to capture images of a aligned scene. The system a target illuminator configured to illuminate the aligned scene. The system includes one or more processors. The system includes computer-readable memory encoded with instructions that, when executed by the one or more processors, cause the system to detect, using laser-pulse detected, laser pulses reflected by the designated target. The computer-readable memory is encoded with instructions that, when executed by the one or more processors, cause the system to determine, based on the detected laser pulses, a direction of the designated target relative to the optical axis. The computer-readable memory is encoded with instructions that, when executed by the one or more processors, cause the system to generate an output signal indicative of the direction of the designated target relative to the optical axis. The computer-readable memory is encoded with instructions that, when executed by the one or more processors, cause the system to capture SWIR images of the aligned scene. Each of the SWIR images captured at an exposure time period in which the remote LTD is not projecting a laser pulse onto the designated target. The computer-readable memory is encoded with instructions that, when executed by the one or more processors, cause the system to identify an image feature within each of the SWIR images, the image feature corresponding to the designated target. The computer-readable memory is encoded with instructions that, when executed by the one or more processors, cause the system to determine, based on the identified image feature, the direction of the designated target relative to the optical axis. The computer-readable memory is encoded with instructions that, when executed by the one or more processors, cause the system to generate an output signal indicative of the direction of the designated target relative to the optical axis. The computer-readable memory is encoded with instructions that, when executed by the one or more processors, cause the system to illuminate, using the target illuminator, the designated target during an illumination time offset by a Phase Offset Interval (POI) from the exposure time period.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A dual-mode seeker for a guided missile, the dual-mode seeker comprising:

a first-mode target locator configured to:

detect laser pulses reflected by a target within a scene aligned along a missile axis, each of the laser pulses projected onto the target by a remote Laser Target Designator (LTD) thereby designating the target;

determine, based on the detected laser pulses, a direction of the designated target relative to the optical axis; and generate an output signal indicative of the direction of the designated target relative to the missile axis;

a second-mode target locator configured to:

capture Short-Wavelength InfraRed (SWIR) images of the aligned scene, each of the SWIR images captured at an exposure time period in which the remote LTD is not projecting a laser pulse onto the designated target;

identify an image feature within each of the SWIR images, the image feature corresponding to the designated target;

determine, based on the identified image feature, the direction of the designated target relative to the missile axis; and generate an output signal indicative of the direction of the designated target relative to the missile axis; and an active SWIR illuminator aligned parallel to the missile axis and configured to:

illuminate the designated target during an illumination time offset by a Phase Offset Interval (POI) from the exposure time period.

2. The dual-mode seeker of claim 1, wherein illuminating the designated target during the illumination time period offset by the POI from the exposure time period is detectable by the remote LTD to indicate that the dual-mode seeker has identified the image feature corresponding to the designated target.

3. The dual-mode seeker of claim 1, wherein the designated target is illuminated by the active SWIR illuminator during the exposure time period of at least one of the SWIR images.

4. The dual-mode seeker of claim 1, wherein the first-mode target locator is further configured to:

identify, based on the detected laser pulses, a Pulse Repetition Interval (PRI) at which the remote LTD projects the laser pulses onto the target within the scene.

5. The dual-mode seeker of claim 4, wherein the first-mode target locator is further configured to:

interpret, based on the identified PRI, communications from the LTD.

6. The dual-mode seeker of claim 5, wherein the first-mode target locator is further configured to:

generate, based on the interpreted communications, an abort command or a retargeting command.

7. The dual-mode seeker of claim 1, wherein the first-mode target locator is further configured to:

predict, based on the detected laser pulses, a time interval corresponding to a future laser pulse projected by the remote LTD of the designated target within the aligned scene.

8. The dual-mode seeker of claim 1, wherein the second-mode target locator is further configured to:

continue, after identifying the image feature within each of the SWIR images, the capturing, identifying, determining and generating steps of the second-mode target locator in a repetitious fashion.

9. A Laser Target Designator (LTD) for a guided missile, the LTD comprising:

a laser configured to:

project laser pulses onto a target aligned along a laser axis, thereby designating the target, the laser pulses projected at a Pulse Frequency Rate (PFR); and a Short-Wavelength InfraRed (SWIR) camera configured to:

capture SWIR images of a scene aligned along the laser axis;

detect SWIR illumination pulses of the designated target by a target illuminator of a guided missile; and identify a Pulse Offset Interval (POI) between the projected laser pulses and the detected SWIR illumination pulses.

10. The LTD of claim 9, wherein the SWIR camera is further configured to:

generate an output signal indicative that the POI corresponds to a predetermined interval.

11. The LTD of claim 9, wherein the SWIR camera is further configured to:

display, on a display screen, indicia indicative the detected SWIR illumination pulses.

12. The LTD of claim 9, wherein the laser is further configured to:

project secondary laser pulses onto the aligned target at a Secondary Offset Interval (SOI) between the detected SWIR illumination pulses and the projected secondary laser pulses.

13. The LTD of claim 9, wherein projecting secondary laser pulses is indicative of a retargeting command or an abort command.

14. A method of tracking a target for a guided missile, the method comprising:

detecting laser pulses reflected by a designated target;

determining based on the detected laser pulses, a direction of the designated target;

capturing Short-Wavelength InfraRed (SWIR) images of a scene that includes the designated target, each of the SWIR images captured at an exposure time period in which laser pulses are not being projected onto the designated target;

identifying an image feature within each of the SWIR images, the image feature corresponding to the designated target;

determining, based on the identified image feature, the direction of the designated target;

generating an output signal indicative of the direction of the designated target; and illuminating the designated target during an illumination time offset by a Phase Offset Interval (POI) from a time period corresponding to the detected laser pulses.

15. The method of claim 14, wherein illuminating the designated target during the illumination time period offset by the POI from the time period corresponding to the detected laser pulses communicates to a remote Laser Target Detector (LTD) that the image feature corresponding to the designated target has been identified.

16. The method of claim 14, wherein the illumination time period coincides with the exposure time period.

17. The method of claim 14, further comprising:

identifying, based on the detected laser pulses, a Pulse Repetition Interval (PRI) at which a remote LTD designates the target within the scene.

18. The method of claim 17, further comprising:

interpreting, based on the identified PRI, communications from the LTD.

19. The method of claim 18, further comprising:

generating, based on the interpreted communications, an abort command or a retargeting command.

20. The method of claim 14, further comprising:

predicting, based on the detected laser pulses, a time interval corresponding to a next designation by a remote LTD of the designated target within the aligned scene.

* * * * *